US009795268B2

(12) United States Patent
Hoyle

(10) Patent No.: US 9,795,268 B2
(45) Date of Patent: Oct. 24, 2017

(54) HANDLE APPARATUS AND CLEANING DEVICE COMPRISING SAME

(71) Applicant: Cedar Creek Cleaning Products, LLC, Mooresville, NC (US)

(72) Inventor: Mark Allen Hoyle, Winchester, VA (US)

(73) Assignee: Cedar Creek Cleaning Products, LLC, Mooresville, NC (US)

( * ) Notice: Subject to any disclaimer, the term of this patent is extended or adjusted under 35 U.S.C. 154(b) by 65 days.

(21) Appl. No.: 14/993,377

(22) Filed: Jan. 12, 2016

(65) Prior Publication Data

US 2016/0198925 A1 Jul. 14, 2016

Related U.S. Application Data

(60) Provisional application No. 62/102,648, filed on Jan. 13, 2015.

(51) Int. Cl.
*A47L 13/42* (2006.01)
*A47L 13/22* (2006.01)

(52) U.S. Cl.
CPC ..... *A47L 13/42* (2013.01); *A47L 13/22* (2013.01)

(58) Field of Classification Search
CPC combination set(s) only.
See application file for complete search history.

(56) References Cited

U.S. PATENT DOCUMENTS 239,126 A 3/1881 Wagner
418,167 A * 12/1889 Copelin ..... B25B 15/04 16/430
D19,998 S 7/1890 Schmidt
1,112,906 A * 10/1914 Hewett ..... A47L 13/22 401/137

(Continued)

FOREIGN PATENT DOCUMENTS

EP 2377447 A1 10/2011
JP D1124314 10/2001

(Continued)

OTHER PUBLICATIONS

Google, English translation of European Patent Application No. EP2377447, Oct. 19, 2011.

(Continued)

*Primary Examiner* — David Walczak
(74) *Attorney, Agent, or Firm* — Ashley Law Firm P.C.; Stephen S. Ashley, Jr.

(57) ABSTRACT

A handle apparatus includes a substantially elongate cylindrical section, a bulbous top section formed at the top of the elongate cylindrical section, and a flange section formed proximate the bottom of the cylindrical section. A trigger can be positioned within a recess formed in the elongate cylindrical section. The flange can extend outwardly from the elongate cylindrical section a greater distance than the trigger to prevent damage to the trigger if the handle falls to the ground. The bulbous section can have an oblate spheroid shape, and a gripping band that provides a comfortable grip to the user and helps prevent the handle from slipping when leaned against a wall. The handle can be utilized on a cleaning implement, such as a liquid dispensing mop.

17 Claims, 9 Drawing Sheets

(56) References Cited

U.S. PATENT DOCUMENTS

| | | | | |
|---|---|---|---|---|
| 2,237,969 | A * | 4/1941 | Olsen | A47L 13/24 15/143.1 |
| 2,279,324 | A | 4/1942 | Julien | |
| 2,449,575 | A * | 9/1948 | Wilhelm | B62D 1/043 16/430 |
| 3,564,779 | A * | 2/1971 | Koehn | A47L 13/02 401/140 |
| D249,014 | S | 8/1978 | Groeneveld | |
| D274,565 | S | 7/1984 | Smith, Jr. et al. | |
| 5,390,572 | A * | 2/1995 | Gakhar | B25B 15/02 16/430 |
| D360,123 | S | 7/1995 | Shu | |
| 5,581,839 | A | 12/1996 | Ferrell, Jr. | |
| D383,578 | S | 9/1997 | Ho | |
| D421,881 | S | 3/2000 | Wen | |
| D433,793 | S | 11/2000 | San | |
| 6,343,885 | B1 * | 2/2002 | Heyne | B43K 7/005 16/430 |
| D530,050 | S | 10/2006 | Bizzotto | |
| D547,017 | S | 7/2007 | Van Landingham, Jr. et al. | |
| 7,281,288 | B1 | 10/2007 | McKay | |
| D563,068 | S | 2/2008 | Jiang | |
| D576,801 | S | 9/2008 | Dretzka | |
| D584,022 | S | 12/2008 | Sampaio | |
| D590,117 | S | 4/2009 | Crawford et al. | |
| D597,269 | S | 7/2009 | McNeil | |
| D602,664 | S | 10/2009 | Crawford et al. | |
| D612,706 | S | 3/2010 | Libman | |
| D614,823 | S | 4/2010 | Blom | |
| D618,411 | S | 6/2010 | Crawford et al. | |
| 7,992,258 | B1 * | 8/2011 | Stitser | A45B 3/00 16/111.1 |
| D660,535 | S | 5/2012 | Menius | |
| D673,336 | S | 12/2012 | Kandasamy et al. | |
| D680,290 | S | 4/2013 | Hsiao | |
| 8,449,212 | B2 | 5/2013 | Crawford et al. | |
| 8,510,874 | B2 * | 8/2013 | Duboc | E03D 9/00 4/255.11 |
| 8,596,896 | B2 * | 12/2013 | Kimura | A47L 13/22 15/115 |
| 8,616,098 | B1 | 12/2013 | Rosow | |
| D698,112 | S | 1/2014 | Molinet | |
| D705,619 | S | 5/2014 | Masalin | |
| 8,834,053 | B2 | 9/2014 | Van Landingham, Jr. et al. | |
| D742,609 | S | 11/2015 | Irwin | |
| D746,649 | S | 1/2016 | McConnell | |
| 2002/0144369 | A1 | 10/2002 | Biggs | |
| 2005/0251943 | A1 | 11/2005 | Van Landingham, Jr. | |
| 2006/0280546 | A1 | 12/2006 | Dyer | |
| 2007/0044265 | A1 | 3/2007 | Crevling | |
| 2010/0293755 | A1 * | 11/2010 | Draper | A45C 13/262 16/430 |
| 2012/0255138 | A1 | 10/2012 | Dingert et al. | |
| 2013/0223919 | A1 | 8/2013 | Brecht | |

FOREIGN PATENT DOCUMENTS

| | | |
|---|---|---|
| JP | D1423585 | 9/2011 |
| WO | WO2005108015 A1 | 11/2005 |

OTHER PUBLICATIONS

Greenspeed, Sprenkler Handle "Limited Edition" with Integrated Reservoir, http://www.greenspeed.eu/article_details.asp?article=3301161#1, Feb. 15, 2017.

Jon-Don, The Mopster Bucketless Mopping System, http://www.jondon.com/mopster-bucketless-handle.html?gclid=CPdrazUk9ICFYiCswodRooNjA, Feb. 15, 2017.

* cited by examiner

HANDLE APPARATUS AND CLEANING DEVICE COMPRISING SAME

CROSS REFERENCE TO RELATED APPLICATIONS

This application claims priority to U.S. Provisional Patent Application No. 62/102,648, filed Jan. 13, 2015, and which is incorporated herein.

TECHNICAL FIELD OF INVENTION

The present invention relates to a handle apparatus that can be used on cleaning implements and the like. One embodiment of the invention comprises a multi-function one piece top grip and trigger apparatus for a liquid dispensing or spray mop.

BACKGROUND OF INVENTION

The trigger and handle interface on many current liquid dispensing or spray mops are uncomfortable to use, and designed to be merely the triggers for the spray mop. These triggers are typically designed to be operated in only one hand position, and to be activated with only two fingers at any one time, which causes stress on the user's hand muscles. A frequent problem with liquid dispensing/spray mops, which are not used with a bucket, is that when a user attempts to lean the mop handle against a wall in a resting position, the handle will often slide against the wall and fall onto the floor, frequently resulting in damage to the trigger.

Also, the top grip area is the control area when mopping, where the hand applies pressure to twist the mop in a figure eight motion. Current spray mops having a straight handle without grips can cause the user to grip the mop tightly when mopping and hold the wrist at an odd angle, leading to fatigue and injury. When using the mop as a dust mop (straight line pushing), the grip is the single point where the user holds and controls the mop. When used vertically to clean walls, the user supports the mop with two hands with one being on the top grip. This is also an important area when transporting the mop by carrying. Current spray mops do not include a top grip that addresses all six of these uses.

SUMMARY OF INVENTION

An object of the present invention is to provide a multi-functional handle apparatus for use on a cleaning instrument, such as a mop. Another object of the invention is to provide a handle apparatus that reduces the likelihood of sliding against a wall and falling to the floor. Yet another object of the invention is to provide a handle apparatus that includes a trigger and means for protecting the trigger in the event the apparatus falls to the floor. These and other objects of the invention can be achieved in various embodiments of the invention described below.

One embodiment of the invention comprises a handle apparatus comprising a substantially cylindrical elongate section having a top end and a bottom end opposite the top end, an oblate spheroid section positioned at the top end of the substantially cylindrical elongate section, and a flange section formed proximate the bottom end and extending outwardly from the substantially cylindrical elongate section.

According to another embodiment of the invention, a gripping band is positioned on the outer surface of the oblate spheroid section. The gripping band facilitates frictional engagement with a wall surface when the handle apparatus is leaned against the wall.

According to another embodiment of the invention, the gripping band is made of thermoplastic elastomer rubber.

According to another embodiment of the invention, a plurality of indentations are formed in the gripping band.

According to another embodiment of the invention, a trigger is attached to the substantially cylindrical elongate section and extends outwardly therefrom.

According to another embodiment of the invention, a recess is formed within the substantially cylindrical elongate section, and the trigger is positioned within said recess.

According to another embodiment of the invention, the flange section extends outwardly from the substantially cylindrical elongate section a greater distance than the trigger.

A handle apparatus according to another embodiment of the invention comprises a substantially cylindrical elongate section having first and second opposed ends, a trigger attached to the substantially cylindrical elongate section and extending outwardly therefrom, and a flange section formed proximate the first end. The flange section extends outwardly from the substantially cylindrical elongate section a greater distance than the trigger.

According to another embodiment of the invention, a bulbous top section is formed at the second end of the substantially cylindrical elongate section.

According to another embodiment of the invention, the bulbous top section has an oblate spheroid shape.

According to another embodiment of the invention, the bulbous top section has a gripping band on its outer surface that is comprised of a material having a high coefficient of friction that facilitates frictional engagement with a wall surface.

According to another embodiment of the invention, the gripping band is made of thermoplastic elastomer rubber, and a plurality of indentations are formed in the gripping band.

Another embodiment of the invention comprises a cleaning apparatus comprising an elongate shaft having an upper end and a base end, a cleaning head adapted for cleaning a floor surface attached at the base end of the shaft, and a handle attached at the upper end of the shaft adapted for gripping by a hand of a user. The handle comprises a substantially cylindrical elongate section having a top end and a bottom end, and an oblate spheroid section positioned at the top end of the substantially cylindrical elongate section.

According to another embodiment of the invention, the handle includes a trigger attached to the substantially cylindrical elongate section and extending outwardly therefrom, and a flange formed proximate the bottom end and extending outwardly from the substantially cylindrical elongate section a greater distance than the trigger. As such, the flange prevents the trigger from contacting a floor when the cleaning apparatus falls to the floor.

According to another embodiment of the invention, the cleaning apparatus includes a liquid dispensing unit attached to the elongate shaft. The liquid dispensing unit contains a cleaning liquid and is operatively connected to the trigger and the cleaning head, such that pressing the trigger causes a predetermined amount of the cleaning liquid to be dispensed from the liquid dispensing unit and move to the cleaning head.

According to another embodiment of the invention, the cleaning apparatus is a liquid dispensing mop.

According to another embodiment of the invention, the handle includes an aperture formed proximate the bottom end. The handle is attached to the elongate shaft by a fastening member, such as a pin or screw, received in the aperture and attached to the elongate shaft.

According to another embodiment of the invention, the handle includes a gripping band on the outer surface of the oblate spheroid section and extending around a circumference of the oblate spheroid section. The gripping band facilitates frictional engagement with a wall surface when the handle is leaned against the wall surface.

According to another embodiment of the invention, the gripping band is comprised of thermoplastic elastomer rubber.

According to another embodiment of the invention, a plurality of indentations are formed in the gripping band.

DETAILED DESCRIPTION OF PREFERRED EMBODIMENTS OF INVENTION

Figure 1:
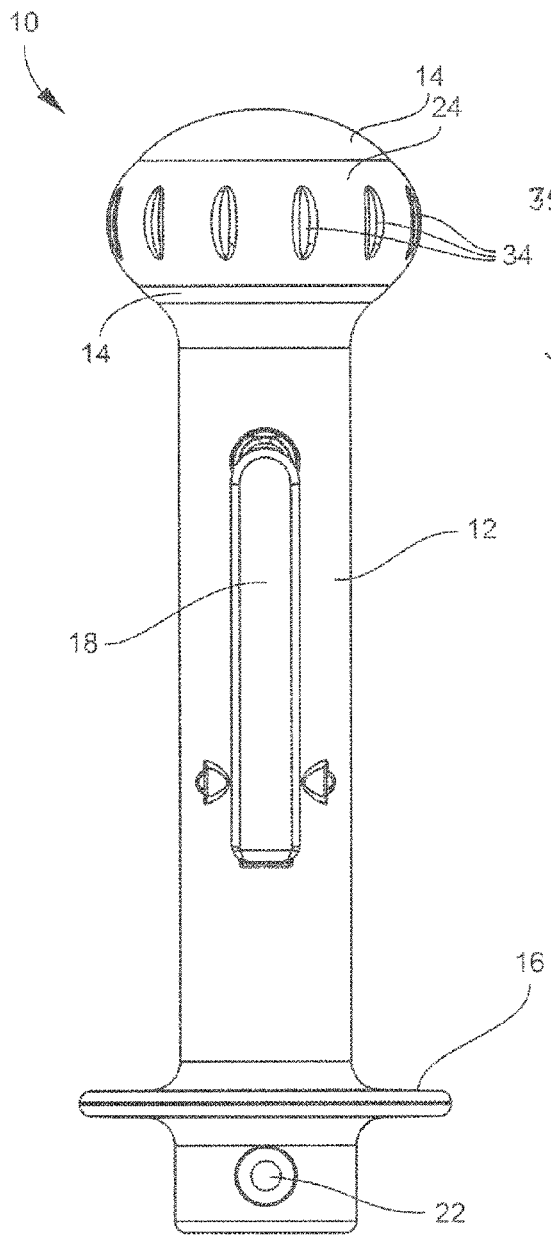
FIG. 1 is a front view of a handle apparatus according to a preferred embodiment of the invention.
Figure 2:
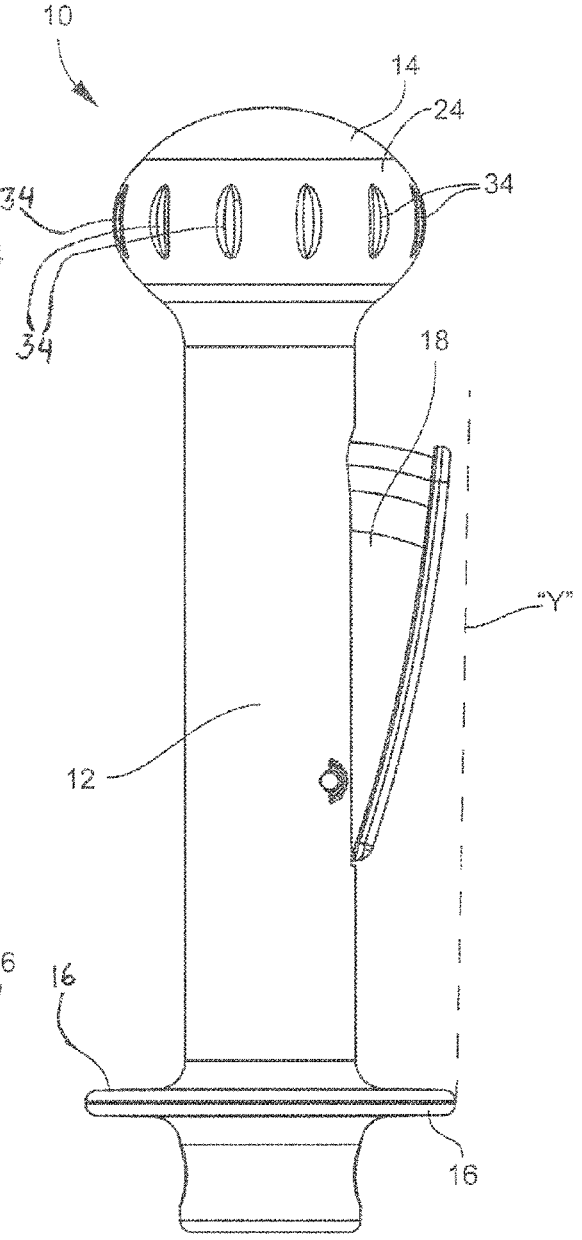
FIG. 2 is a side view of the handle apparatus of FIG. 1.
Figure 3:
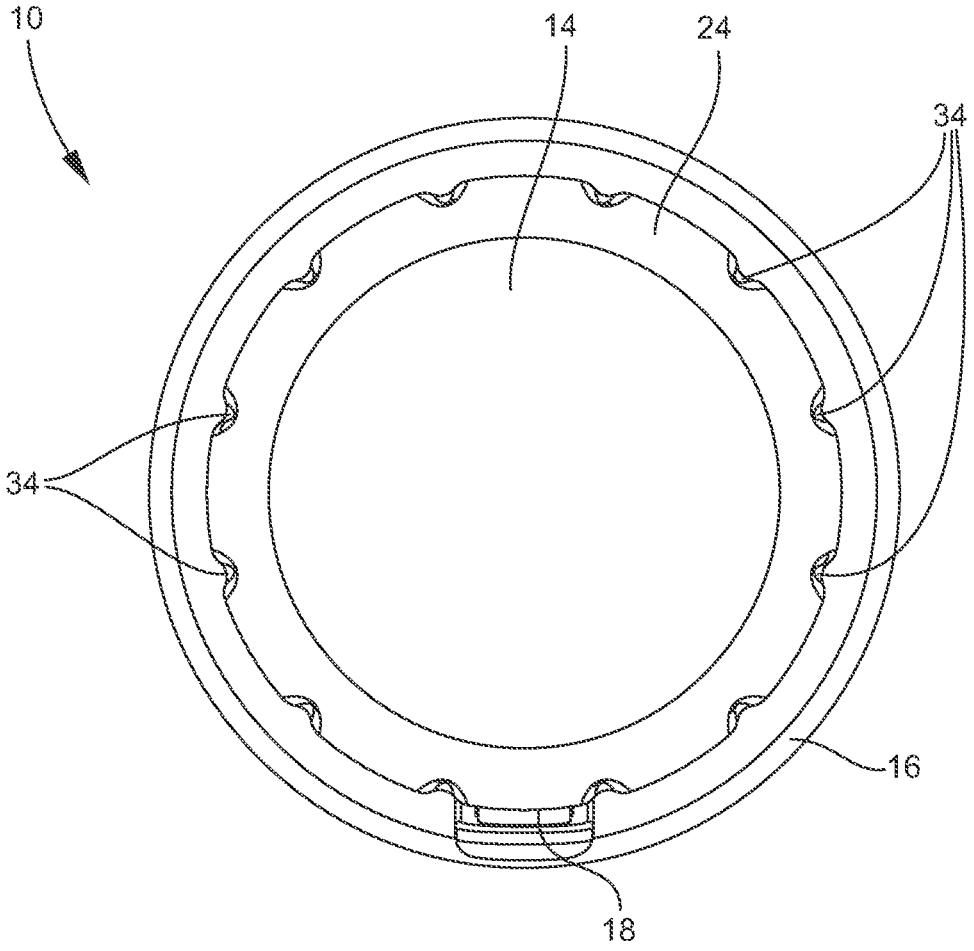
FIG. 3 is a top plan view of the handle apparatus of FIG. 1.

A handle apparatus according to a preferred embodiment of the invention is illustrated in FIGS. 1-3, and shown generally at reference numeral 10. As shown in FIGS. 1 and 2, the apparatus 10 comprises an elongate cylindrical shaft section 12, a bulbous section 14 formed at the top of the elongate cylindrical section 12, a flange section 16 formed proximate the bottom of the cylindrical section 12. A trigger 18 is positioned within a recess formed in the elongate cylindrical section 12, as shown in FIGS. 1 and 2. The handle 10 can generally be made of plastic or other suitable material. The handle 10 can be made by injection molding or other suitable process.

Figure 4:
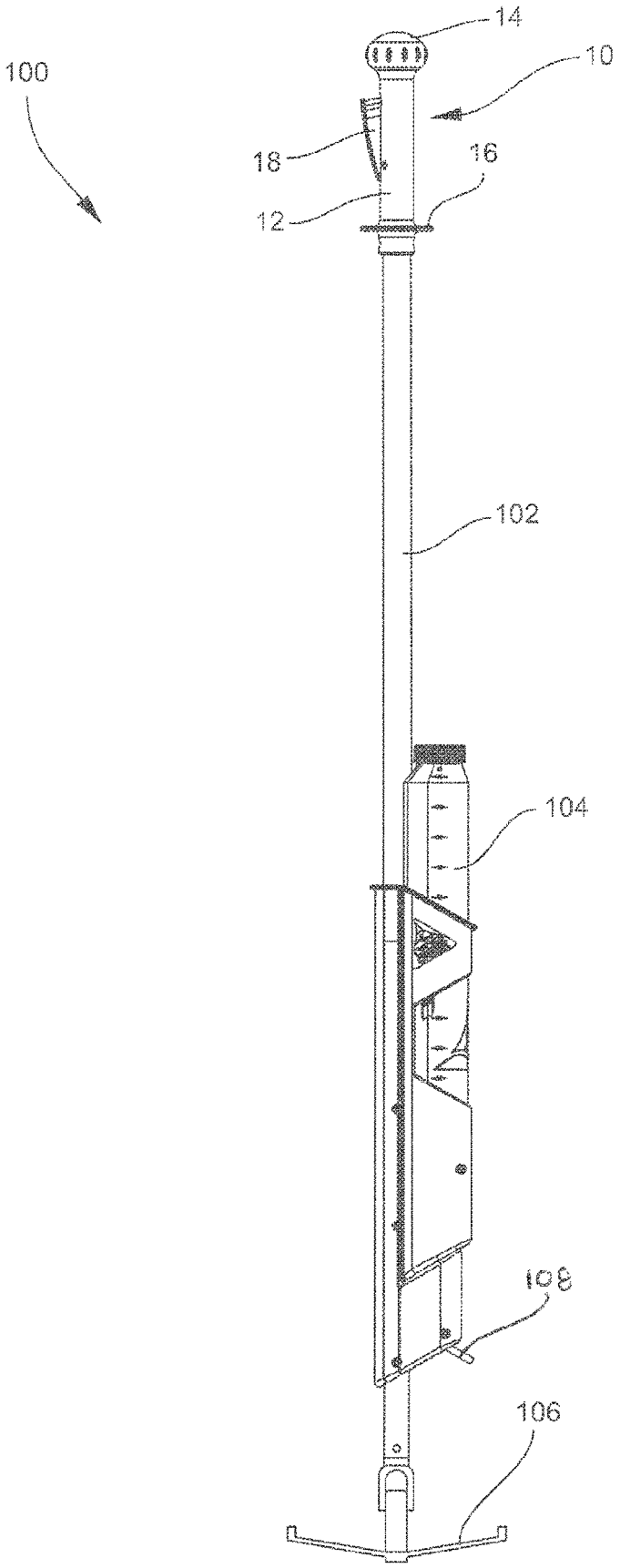
FIG. 4 is a side view of a cleaning device according to a preferred embodiment of the invention.
Figure 5:
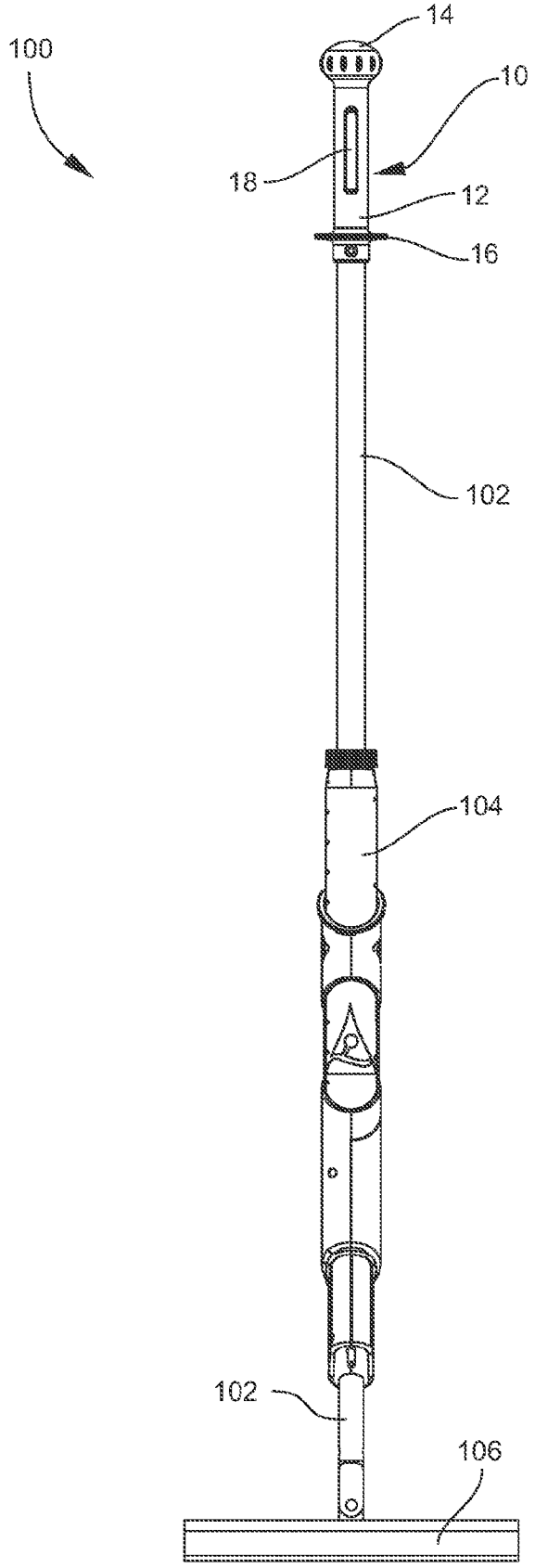
FIG. 5 is a front elevation of the handle apparatus of FIG. 4.

The handle apparatus 10 can be utilized on a cleaning implement, such as a liquid dispensing mop. A liquid dispensing mop according to a preferred embodiment of the invention is illustrated in FIGS. 4 and 5, and shown generally at reference numeral 100. The handle apparatus 10 is mounted at the top of an elongate shaft 102 of the mop 100, as shown in FIGS. 4 and 5. The handle 10 can include an aperture 22 for receiving a fastening member, such as a screw or pin, to attach the handle 10 to the shaft 102 of the mop 100. The trigger 18 of the handle 10 can be operatively connected to a liquid dispensing unit 104 containing a supply of cleaning liquid. The trigger can be operatively connected such that pressing down on the trigger 18 causes the liquid dispensing unit 104 to dispense a predetermined amount of cleaning liquid through a tube 108 proximate a cleaning head 106 that is attached at the bottom of the mop shaft 102.

Figure 6:
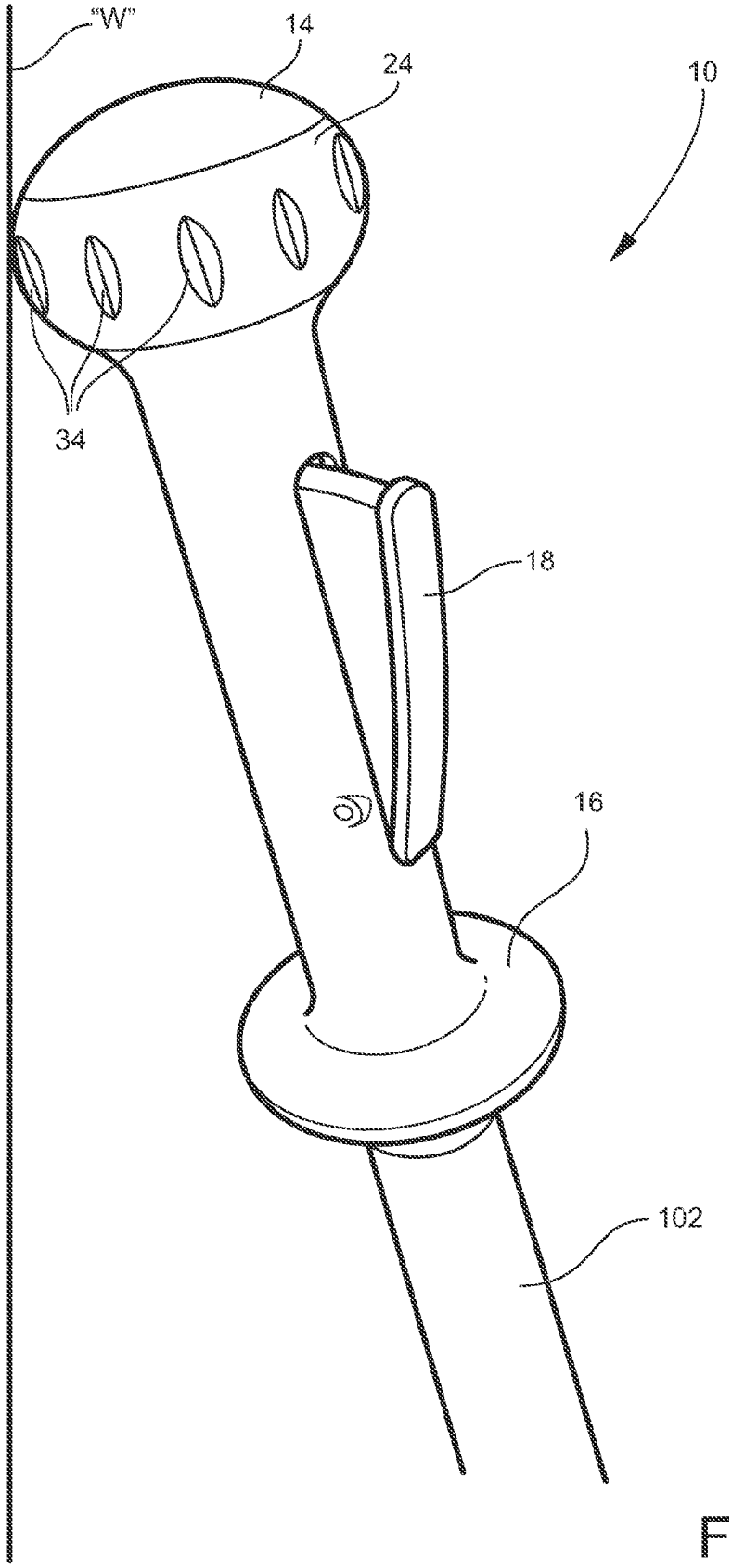
FIG. 6 is an environmental perspective view of the handle apparatus of FIG. 1.

The bulbous top section 14 has an oblate (flattened) spheroid shape, as shown in FIGS. 1 and 2. That is, the shape of a flattened ball. The bulbous top section 14 can include a gripping band 24, shown in FIGS. 1-3, extending around the circumference of the bulbous top section 14. The gripping band 24 is comprised of a material having a high coefficient of friction such that when placed against wall surface the gripping band 24 frictionally engages the surface, thereby reducing the tendency of the handle 10 to slide when leaned against a wall "W", as shown in FIG. 6. The gripping band 24 can be comprised of black thermoplastic elastomer (TPE) rubber that is in-molded to the top section 14. A plurality of indentations 34 can be formed in the gripping band 24, as shown in FIGS. 1-3. The indentations 34 help further facilitate frictional engagement reducing the risk of sliding against a wall surface. The gripping band 24 can hold the mop 100 in place when the mop is placed against the wall at a side angle of up to thirty degrees. In addition, the indentations 34 provide a more comfortable grip for the user. The indentations 34 helps the user's hand grip the handle 10 when mopping thus reducing the force necessary to hold the mop 100 and give it a twisting motion.

Figure 7:
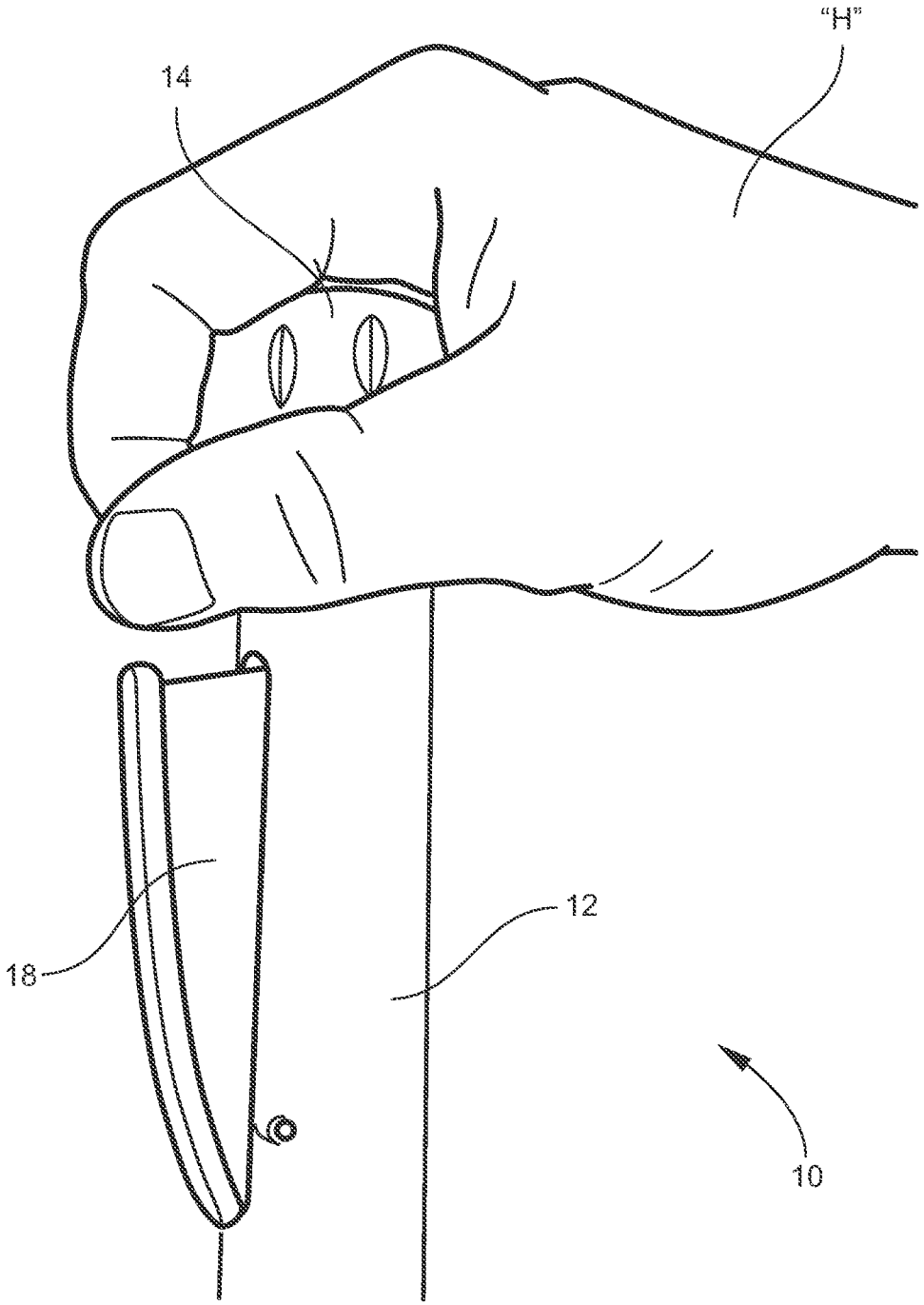
FIG. 7 is another environmental perspective view of the handle apparatus of FIG. 1.

The oblate spheroid shape of the top section 14 properly fits the human hand when gripped from above, as shown in FIG. 7, for damp mopping. This flattened ball shape of the top section 14 provides a more ergonomic fit for the user's hand than a completely round ball shape. The top section 14 is multi-functional as it provides a more comfortable grip for the user and reduces the risk of the mop 100 slipping when leaned against the wall "W", as shown in FIG. 6.

Figure 8:
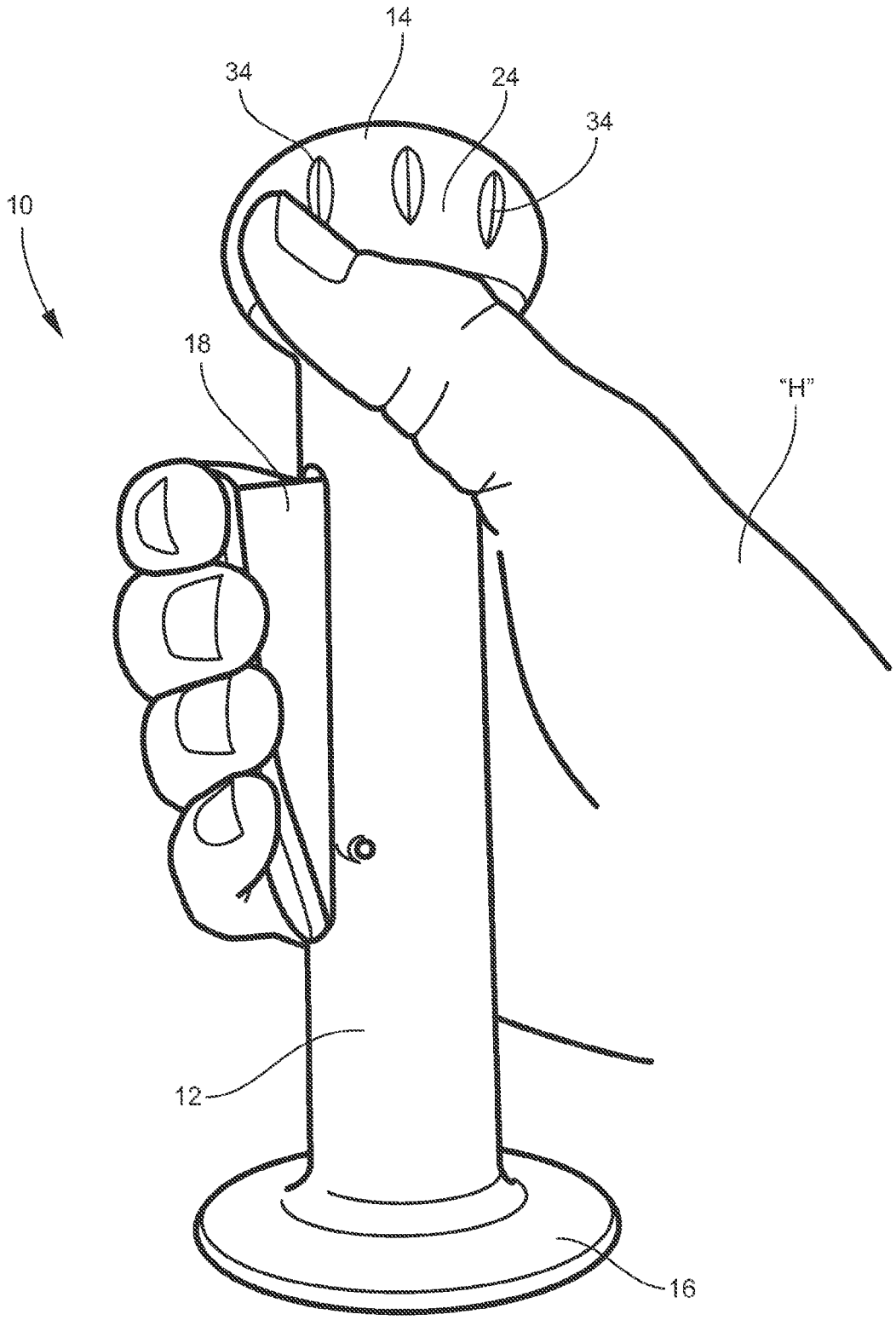
FIG. 8 is another environmental perspective view of the handle apparatus of FIG. 1.
Figure 9:
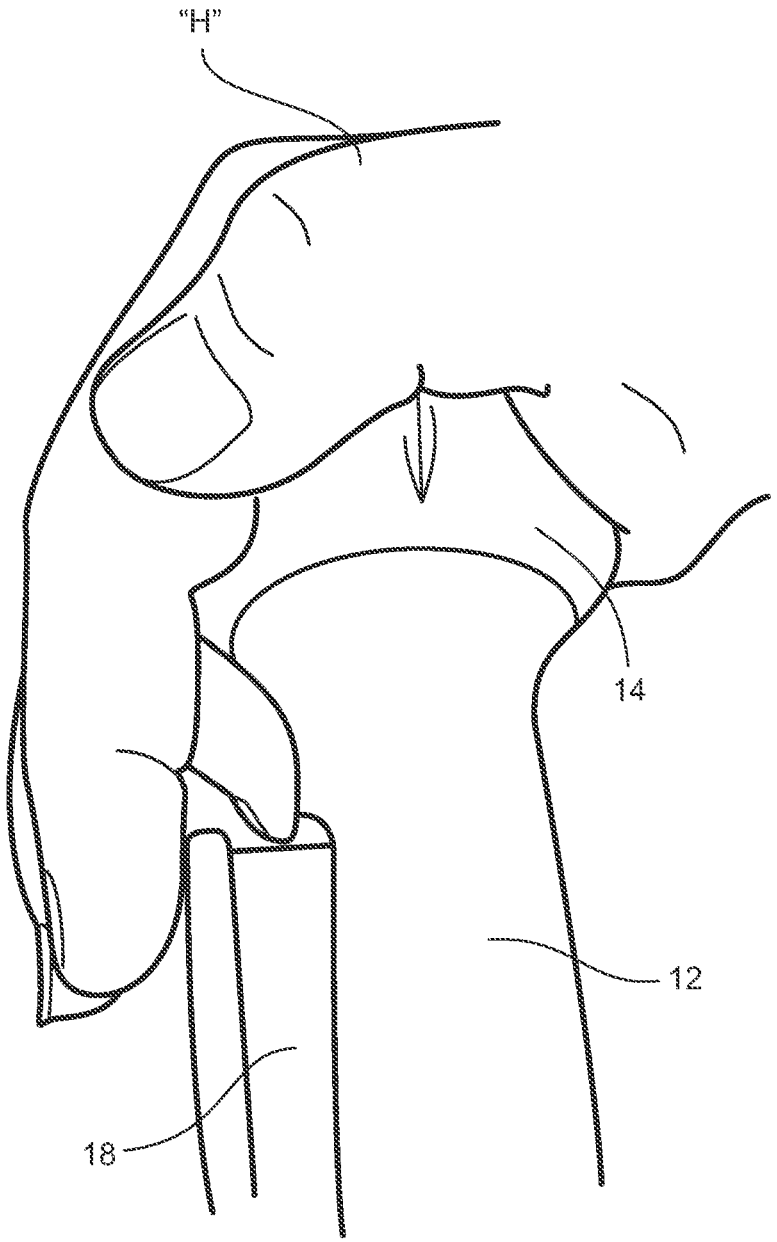
FIG. 9 is another environmental perspective view of the handle apparatus of FIG. 1.

The trigger can be operated with a full hand handgrip of four fingers on the trigger 18, as shown in FIG. 8, a partial grip of less than four fingers, or from above with the user's palm on the top section 14 and a single finger on the trigger 18, as shown in FIG. 9.

The flange 16 extends around the circumference of the cylindrical section 12 proximate the base of the cylindrical section 12, as shown in FIGS. 1 and 2. The outer edge of the flange reaches slightly beyond the depth of the trigger 18, as illustrated by the "Y" axis in FIG. 2. As such, if the mop 100 is dropped or falls to the floor, the flange 16 hits the floor preventing the trigger 18 from directly impacting the floor, thus protecting the trigger 18 from damage.

Figure 10:
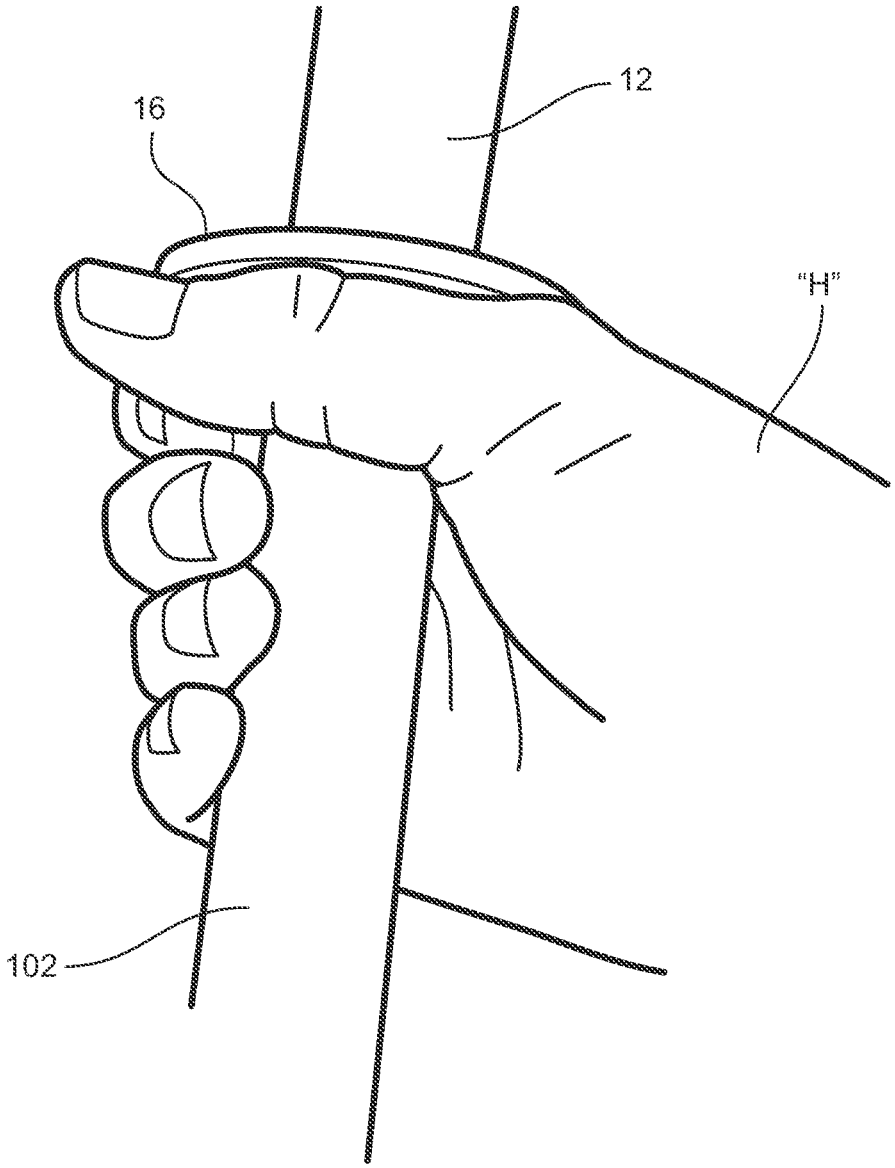
FIG. 10 is another environmental perspective view of the handle apparatus of FIG. 1.

In addition, the flange 16 can reduce stress on the user when dust mopping by pushing the mop 100 and handle 10 like a vacuum, and also when using the mop 100 in a vertical position to clean walls. The user can rest his hand "H" against the flange 16, as shown in FIG. 10. This allows the user to rest the mop 100 on their hand "H" without a tight grip during straight line dust mopping or overhead mopping. Also, during overhead use, the flange 16 prevents water from flowing down the handle 10 and onto the user.

The handle apparatus 10 provides a variety of functional benefits. The trigger 18 is adapted for operation in multiple hand positions to reduce user stress when dispensing the cleaning solution. The handle 10 helps prevents the mop 100 from sliding on a wall and falling to the floor. The shape, finish and design of the bulbous top section 14 reduces stress on the user when damp mopping. The flange 16 protects the trigger 18 from breakage if the mop 100 falls to the floor, and reduces stress on the user when straight-line dust mopping, cleaning walls and working overhead.

A handle apparatus and cleaning device comprising same are described above. Various changes can be made to the invention without departing from its scope. The foregoing description of embodiments of the invention are provided for the purpose of illustration only and not limitation—the invention being defined by the claims and equivalents thereof.

What is claimed is:

1. A cleaning apparatus comprising:

(a) an elongate shaft having an upper end and a base end opposite the upper end;

(b) a cleaning head adapted for cleaning a floor surface attached at the base end of the shaft; and (c) a handle attached at the upper end of the shaft adapted for gripping by a hand of a user, the handle comprising a substantially cylindrical elongate section having a top end and a bottom end opposite the top end, and an oblate spheroid section positioned at the top end of the substantially cylindrical elongate section, the handle further comprising a trigger attached to the substantially cylindrical elongate section and extending outwardly therefrom, and a flange formed proximate the bottom end and extending outwardly from the substantially cylindrical elongate section a greater distance than the trigger, whereby the flange prevents the trigger from contacting a floor when the cleaning apparatus falls to the floor.

2. The cleaning apparatus according to claim 1, wherein the handle includes a recess formed within the substantially cylindrical elongate section, and the trigger is positioned within said recess.

3. The cleaning apparatus according to claim 1, further comprising a liquid dispensing unit attached to the elongate shaft and containing a liquid, the liquid dispensing unit operatively connected to the trigger, whereby pressing the trigger causes a predetermined amount of the liquid contained in the liquid dispensing unit to be dispensed from the liquid dispensing unit.

4. The cleaning apparatus according to claim 1, wherein the handle includes an aperture formed proximate the bottom end, and the handle is attached to the elongate shaft by a fastening member received in said aperture and attached to the elongate shaft.

5. The cleaning apparatus according to claim 1, wherein the handle further comprises a gripping band positioned on an outer surface of the oblate spheroid section and extending around a circumference of the oblate spheroid section, the gripping band adapted for facilitating frictional engagement with a wall surface when the handle is leaned against the wall surface.

6. The cleaning apparatus according to claim 5, wherein the gripping band is comprised of thermoplastic elastomer rubber.

7. The handle apparatus according to claim 5, wherein a plurality of indentations are formed in the gripping band.

8. A cleaning apparatus comprising:

(a) an elongate shaft having an upper end and a base end opposite the upper end;

(b) a cleaning head adapted for cleaning a floor surface attached at the base end of the elongate shaft; and (c) a handle attached at the upper end of the elongate shaft adapted for gripping by a hand of a user, the handle comprising:

(i) a substantially cylindrical elongate section having a first end and a second end opposite the first end, (ii) a trigger attached to the substantially cylindrical elongate section and extending outwardly therefrom, and (iii) a flange section formed proximate the first end and extending outwardly from the substantially cylindrical elongate section a greater distance than the trigger, whereby the flange prevents the trigger from contacting a floor when the cleaning apparatus falls to the floor.

9. The cleaning apparatus according to claim 8, wherein the handle further comprises a bulbous top section formed at the second end of the substantially cylindrical elongate section.

10. The cleaning apparatus according to claim 9, wherein the bulbous top section has an oblate spheroid shape.

11. The cleaning apparatus according to claim 9, wherein a gripping band is positioned on an outer surface of the bulbous top section, the gripping band comprised of a material having a coefficient of friction that facilitates frictional engagement with a wall surface.

12. The cleaning apparatus according to claim 11, wherein the gripping band is comprised of thermoplastic elastomer rubber, and a plurality of indentations are formed in the gripping band.

13. The cleaning apparatus according to claim 8, wherein the flange section extends around the entire circumference of the substantially cylindrical elongate section of the handle.

14. The cleaning apparatus according to claim 8, wherein the handle includes an aperture formed proximate the bottom end, and the handle is attached to the elongate shaft by a fastening member received in said aperture and attached to the elongate shaft.

15. The cleaning apparatus according to claim 8, wherein a recess is formed within the substantially cylindrical elongate section of the handle, and the trigger is positioned within said recess.

16. The cleaning apparatus according to claim 8, further comprising a liquid dispensing unit attached to the elongate shaft, the liquid dispensing unit containing a liquid for cleaning the floor surface.

17. The cleaning apparatus according to claim 8, wherein the trigger is operatively connected to the liquid dispensing unit, whereby pressing the trigger causes an amount of the liquid contained in the liquid dispensing unit to be dispensed from the liquid dispensing unit.

* * * * *